US011833832B2

(12) United States Patent
Okada et al.

(10) Patent No.: US 11,833,832 B2
(45) Date of Patent: Dec. 5, 2023

(54) LIQUID STORAGE CONTAINER AND LIQUID EJECTION APPARATUS

(71) Applicant: CANON KABUSHIKI KAISHA, Tokyo (JP)

(72) Inventors: Eiji Okada, Tokyo (JP); Shinichi Miyauchi, Kanagawa (JP); Akira Shiba, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 134 days.

(21) Appl. No.: 17/685,151

(22) Filed: Mar. 2, 2022

(65) Prior Publication Data

US 2022/0288940 A1 Sep. 15, 2022

(30) Foreign Application Priority Data

Mar. 9, 2021 (JP) ..... 2021-037186

(51) Int. Cl.
*B41J 2/175* (2006.01)
*B41J 29/13* (2006.01)

(52) U.S. Cl.
CPC ..... *B41J 2/17523* (2013.01); *B41J 2/17503* (2013.01); *B41J 2/17506* (2013.01); *B41J 2/17509* (2013.01); *B41J 2/17513* (2013.01); *B41J 2/17553* (2013.01); *B41J 29/13* (2013.01)

(58) Field of Classification Search
CPC .... B41J 2/175; B41J 2/17503; B41J 2/17506; B41J 2/17509; B41J 2/17513; B41J 2/17523; B41J 2/17553; B41J 19/13
See application file for complete search history.

(56) References Cited

U.S. PATENT DOCUMENTS

| | | | | |
|---|---|---|---|---|
| 6,702,427 | B2 | 3/2004 | Shimizu et al. | 347/50 |
| 6,945,642 | B2 | 9/2005 | Yamamoto et al. | 347/86 |
| 7,726,792 | B2 | 6/2010 | Fukushima et al. | 347/86 |
| 8,240,826 | B2 | 8/2012 | Fukushima et al. | 347/86 |
| 8,454,139 | B2 | 6/2013 | Ishizawa et al. | 347/85 |
| 8,960,875 | B2 | 2/2015 | Shiba et al. | 347/93 |
| 9,139,012 | B2 | 9/2015 | Yamada et al. | B41J 2/17553 |
| 9,242,471 | B2 | 1/2016 | Yoneda et al. | B41J 2/17513 |
| 9,694,585 | B2 | 7/2017 | Shiba et al. | B41J 2/17513 |

(Continued)

FOREIGN PATENT DOCUMENTS

| | | |
|---|---|---|
| JP | 2012-020497 | 2/2012 |
| JP | 2020-157726 | 10/2020 |

*Primary Examiner* — Anh T Vo
(74) *Attorney, Agent, or Firm* — Venable LLP

(57) ABSTRACT

A liquid storage container includes: a storage chamber; a supply port capable of supplying the liquid into the storage chamber; a hollow protruding portion protruding from the supply port; and a plug member attachably and detachably attached to the supply port. The plug member includes: a plug portion for sealing the supply port; a cover portion formed integrally with the plug portion; a pinch portion including a first portion and a second portion provided on the cover portion and opposite to each other; and a hollow portion extending from the cover portion through the plug portion. The plug portion and the cover portion are made of an elastic body, and the hollow portion has an opening on the cover portion side. A width of the opening is narrowed and a side face of the plug portion is deformed toward the hollow portion by pinching the first and second portions.

15 Claims, 12 Drawing Sheets

(56) References Cited

U.S. PATENT DOCUMENTS

| | | | | |
|---|---|---|---|---|
| 9,724,929 | B2 | 8/2017 | Yoshii et al. | B41J 2/1752 |
| 9,914,305 | B2 | 3/2018 | Orihara et al. | B41J 2/17523 |
| 10,093,105 | B2 | 10/2018 | Shimamura et al. | B41J 2/17553 |
| 10,112,403 | B2 * | 10/2018 | Ikebe | B41J 2/1752 |
| 10,160,222 | B2 | 12/2018 | Shiba et al. | B41J 2/17566 |
| 10,391,776 | B2 | 8/2019 | Hayashi et al. | B41J 2/17513 |
| 10,399,346 | B2 | 9/2019 | Arai et al. | B41J 2/175 |
| 10,399,347 | B2 | 9/2019 | Miyashita et al. | B41J 2/17506 |
| 10,427,412 | B2 | 10/2019 | Okude et al. | B41J 2/03 |
| 10,538,092 | B2 | 1/2020 | Miyashita et al. | B41J 2/17523 |
| 10,611,162 | B2 | 4/2020 | Ikebe et al. | B41J 2/17523 |
| 10,618,300 | B2 | 4/2020 | Shimamura et al. | B41J 2/17553 |
| 10,675,882 | B2 | 6/2020 | Shiba et al. | B41J 2/17566 |
| 10,843,474 | B2 | 11/2020 | Arai et al. | B41J 29/13 |
| 11,192,383 | B2 | 12/2021 | Shimamura et al. | B41J 2/17553 |
| 2022/0048295 | A1 | 2/2022 | Shimamura et al. | B41J 2/17553 |

* cited by examiner

LIQUID STORAGE CONTAINER AND LIQUID EJECTION APPARATUS

BACKGROUND OF THE INVENTION

Field of the Invention

The present invention relates to a liquid storage container capable of being refilled with a liquid and a liquid ejection apparatus including the same.

Description of the Related Art

In general, a liquid ejection apparatus which ejects a liquid such as an ink includes a liquid storage container which stores the liquid. Some liquid storage containers can be refilled with the liquid.

Japanese Patent Application Laid-Open No. 2012-20497 describes a liquid storage container into which a liquid can be injected. The liquid storage container described in Japanese Patent Application Laid-Open No. 2012-20497 includes: a storage chamber which stores a liquid; an inlet for injecting the liquid into the storage chamber; and a plug member which seals the inlet. The plug member is press-fitted into the inlet and is detachable and attachable. When the storage chamber is refilled with the liquid, the plug member is removed from the inlet and the liquid is injected into the storage chamber through the inlet.

Japanese Patent Application Laid-Open No. 2020-157726 describes a tank unit in which a liquid-capturing protrusion for capturing a liquid is formed adjacent to an inlet.

However, in the liquid storage container described in Japanese Patent Application Laid-Open No. 2012-20497, there is a case where a liquid adheres to the plug member sealing the inlet. For example, there is a case where the liquid adheres to the plug member due to the rocking of the liquid in the storage chamber which occurs when the liquid ejection apparatus is moved. Hence, the liquid which has adhered to the plug member sometimes scatters to the outside due to back action and impact at the time of removing the plug member from the inlet.

In the tank unit described in Japanese Patent Application Laid-Open No. 2020-157726 as well, since the back action and impact at the time of opening is large, the liquid which has adhered to the plug member sometimes scatters beyond the liquid-capturing protrusion.

The present invention has been made in view of the above-described problems, and has an object to suppress scattering of a liquid at the time of opening.

SUMMARY OF THE INVENTION

In order to achieve the above-described object, a liquid storage container according to an aspect of the present invention includes: a storage chamber which stores a liquid; a supply port which includes a hollow protruding portion protruding from the storage chamber and which is capable of supplying the liquid into the storage chamber; a plug member which is attachably and detachably attached to the supply port. The plug member includes: a plug portion which is inserted into the protruding portion to seal the supply port; a cover portion which is formed integrally with the plug portion and which covers the supply port from outside the storage chamber in a state where the plug portion is inserted in the protruding portion; a pinch portion which is provided on the cover portion and which includes a first portion and a second portion which are opposite to each other; and a hollow portion which is located between the first portion and the second portion and which extends from the cover portion into the plug portion. The plug portion and the cover portion are made of an elastic body, and the hollow portion has an opening on the cover portion side. A width of the opening is narrowed and a side face of the plug portion is deformed toward the hollow portion by pinching the first and second portions.

A liquid storage container according to another aspect of the present invention includes: a storage chamber which stores a liquid; a supply port which includes a hollow protruding portion protruding from the storage chamber and which is capable of supplying the liquid into the storage chamber; and a plug member which is made of an elastic body and which is configured such that a front end portion of the elastic body is inserted into the protruding portion. The plug member includes: a hollow portion which extends from the elastic body toward the front end portion; and a pinch portion which is provided on a rear end of the elastic body and which deforms a side face of the front end portion toward the hollow portion. The pinch portion includes a first portion and a second portion which are opposite to each other with the hollow portion in between in a first direction which intersects the hollow portion, and the front end portion is more likely to deform in the first direction than in a second direction which is orthogonal to the first direction.

Further features of the present invention will become apparent from the following description of exemplary embodiments with reference to the attached drawings.

DESCRIPTION OF THE EMBODIMENTS

Hereinafter, embodiments of the present invention will be described in detail with reference to the drawings. Nevertheless, constituent elements described in the embodiments are only illustrative and are not intended to limit the scope of the present invention to these.

First Embodiment

First, a liquid ejection apparatus to which a liquid storage container of a first embodiment of the present invention is applicable will be described.

Figure 1:
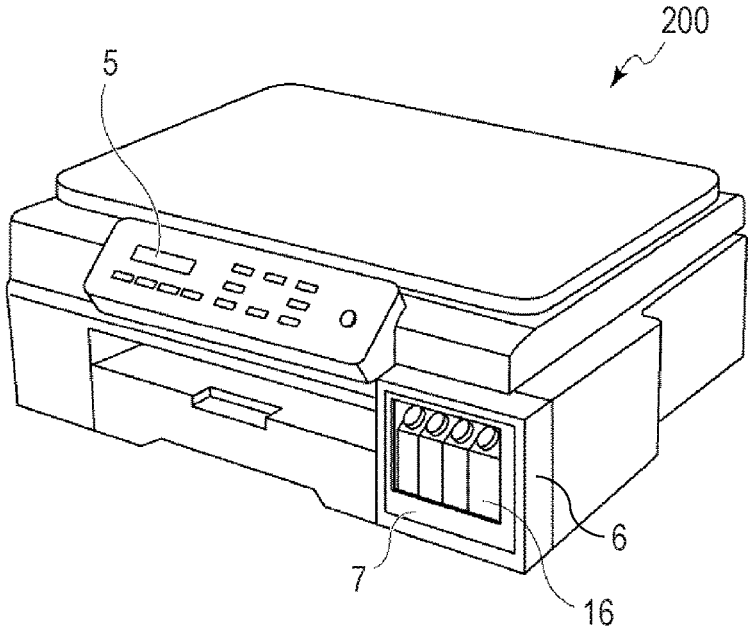
FIG. 1 is a perspective view illustrating an external appearance of a liquid ejection apparatus to which a liquid storage container of the present invention is applicable.
Figure 2:
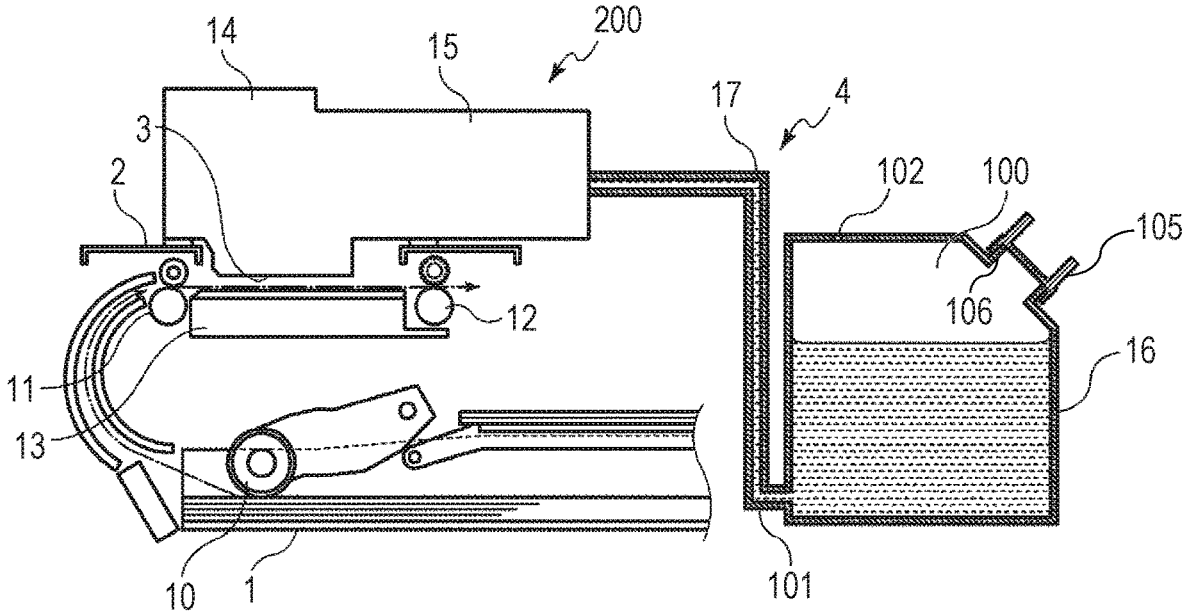
FIG. 2 is a schematic view for explaining a configuration of the liquid ejection apparatus illustrated in FIG. 1.

FIG. 1 is a perspective view illustrating an external appearance of the liquid ejection apparatus. FIG. 2 is a schematic view for explaining a configuration of the liquid ejection apparatus illustrated in FIG. 1.

Referring to FIG. 1 and FIG. 2, the liquid ejection apparatus 200 includes a feed section 1, a transport section 2, an ejection section 3, a liquid supply section 4, a display section 5, and a liquid storage section 6. The feed section 1 includes a tray in which a plurality of printing paper sheets are stored in a pile, and a feed roller 10 which separates the printing paper sheets stored in this tray one by one and supplies the printing paper sheets to the transport section 2.

The transport section 2 includes a transport roller 11, a delivery roller 12, and a platen 13. The platen 13 is arranged between the transport roller 11 and the delivery roller 12. The transport roller 11 transports the printing paper sheet supplied from the feed section 1 onto the platen 13. The platen 13 holds the printing paper sheet. The delivery roller 12 delivers the printing paper sheet transported on the platen 13.

A liquid ejection head 15 includes the ejection section 3 which ejects liquids such as inks. A carriage 14 is located above the platen 13, and is capable of moving in a direction (sub scanning direction) intersecting a transport direction (main scanning direction) of the printing paper sheets. The liquid ejection head 15 is mounted on the carriage 14, and the ejection section 3 ejects the liquids toward the printing paper sheet on the platen 13. In this way, it is possible to form an image on the printing paper sheet based on image information.

A liquid storage container 16 is the liquid storage container of the first embodiment of the present invention. The liquid storage container 16 includes a storage chamber 100 which store the liquids, an air communication port 102, plug members 105, and supply ports 106. The supply ports 106 allow the liquids to be supplied to the storage chamber 100. The plug members 105 are attachably and detachably attached to the supply ports 106. The storage chamber 100 is fluidically coupled to the liquid ejection head 15 through the liquid supply section 4. The liquid supply section 4 includes a flow passage 101 and a flexible supply tube 17 located downstream of the flow passage 101. The liquids are supplied from the storage chamber 100 to the liquid ejection head 15 through the flow passage 101 and the supply tube 17 depending on the amounts of the liquids ejected by the ejection section 3.

Here, liquids of four colors (for example, black, magenta, cyan, and yellow) are used, and the liquid storage container 16, the flow passage 101, and the supply tube 17 are provided for the liquid of each color. Note that the colors of the liquids are an example, and the liquids to be used are not limited to those of four colors. A liquid of one color may be used, or liquids of two or more colors may be used.

The display section 5 displays information necessary to operate the liquid ejection apparatus 200 (the operation state, the operation items, the menu, and the like). The liquid storage section 6 houses the liquid storage container 16. The liquid storage section 6 includes an openable and closable cover 7. With the cover 7 open, it is possible to refill the liquid storage container 16 housed in the liquid storage section 6 with the liquids.

Figure 3:
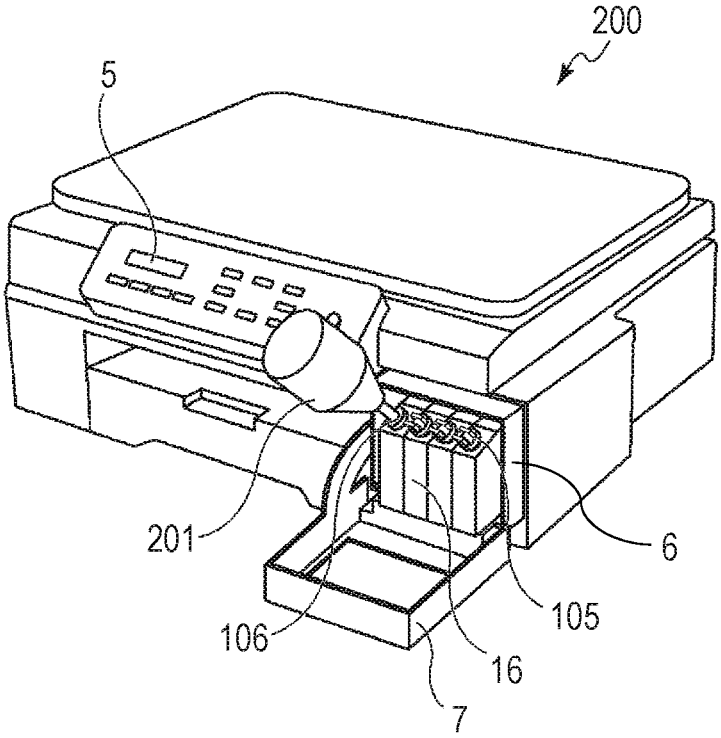
FIG. 3 is a schematic view for explaining the refilling of a liquid storage container with a liquid.

FIG. 3 is a schematic view for explaining the refilling of the liquid storage container 16 housed in the liquid storage section 6 with the liquids. As illustrated in FIG. 3, when the liquid storage container 16 is to be refilled with the liquid, the cover 7 is opened, the plug member 105 is removed from the supply port 106, and the liquid is supplied to the storage chamber 100 from the supply port 106 using the liquid refill container 201. Note that although the liquid storage container 16 is housed in the liquid storage section 6 of the apparatus body in the present embodiment, the configuration is not limited to this. The liquid storage container 16 may be provided outside the apparatus body as long as the liquid storage container 16 is capable of supplying the liquids to the liquid ejection head 15.

Figure 4:
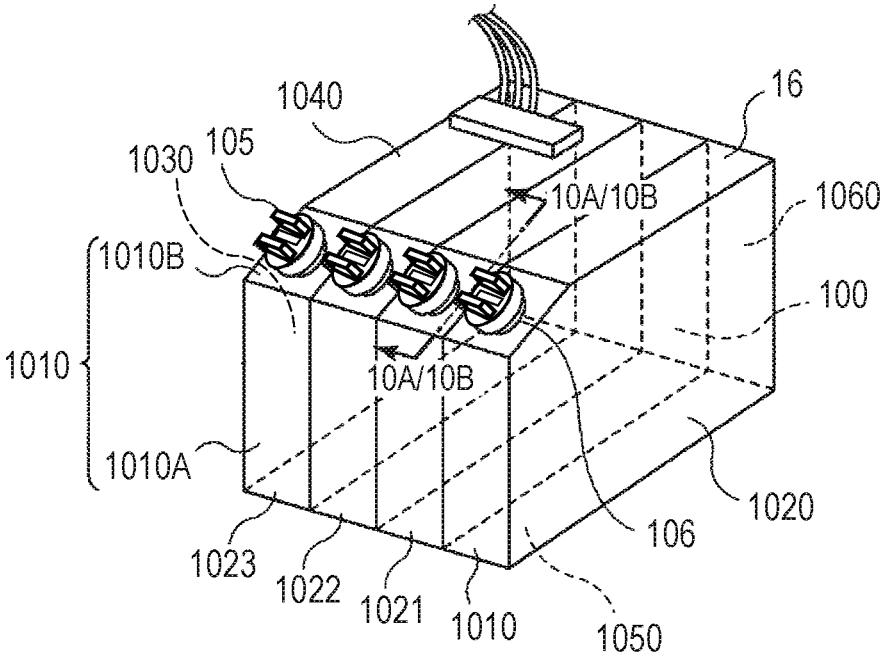
FIG. 4 is a perspective view illustrating a liquid storage container of the first embodiment of the present invention.

FIG. 4 is a perspective view illustrating a schematic configuration of the liquid storage container 16 of the present embodiment. Referring to FIG. 4, the liquid storage container 16 is formed of a synthetic resin such as polypropylene, and has an outer shape of substantially a cuboid. The liquid storage container 16 has a front wall 1010, a right wall 1020, a left wall 1030, an upper wall 1040, and a lower wall 1050. The front wall 1010 has an upright wall 1010A and an inclined wall 1010B. The upright wall 1010A extends from the lower wall 1050 substantially in a vertical direction. The inclined wall 1010B extends from the upper end of the upright wall 1010A toward the upper wall 1040, and is inclined to the upper wall 1040. The inclined wall 1010B is inclined such that the front side is low and the rear side is high in the longitudinal direction. The supply ports 106 are formed in the inclined wall 1010B.

The rear face of the liquid storage container 16 is open, and a film 1060 is welded to the opening face of the liquid storage container 16. This film 1060 as well as the front wall 1010, the right wall 1020, the left wall 1030, the upper wall 1040, and the lower wall 1050 form the storage chamber 100.

In the present embodiment, in order to store the liquids of four colors in the storage chamber 100, three inter-color walls 1021, 1022, and 1023 are provided. In other words, the storage chamber 100 is partitioned into four liquid chambers by the inter-color walls 1021, 1022, and 1023. The supply port 106 and the plug member 105 are provided for each liquid chamber.

Figure 5:
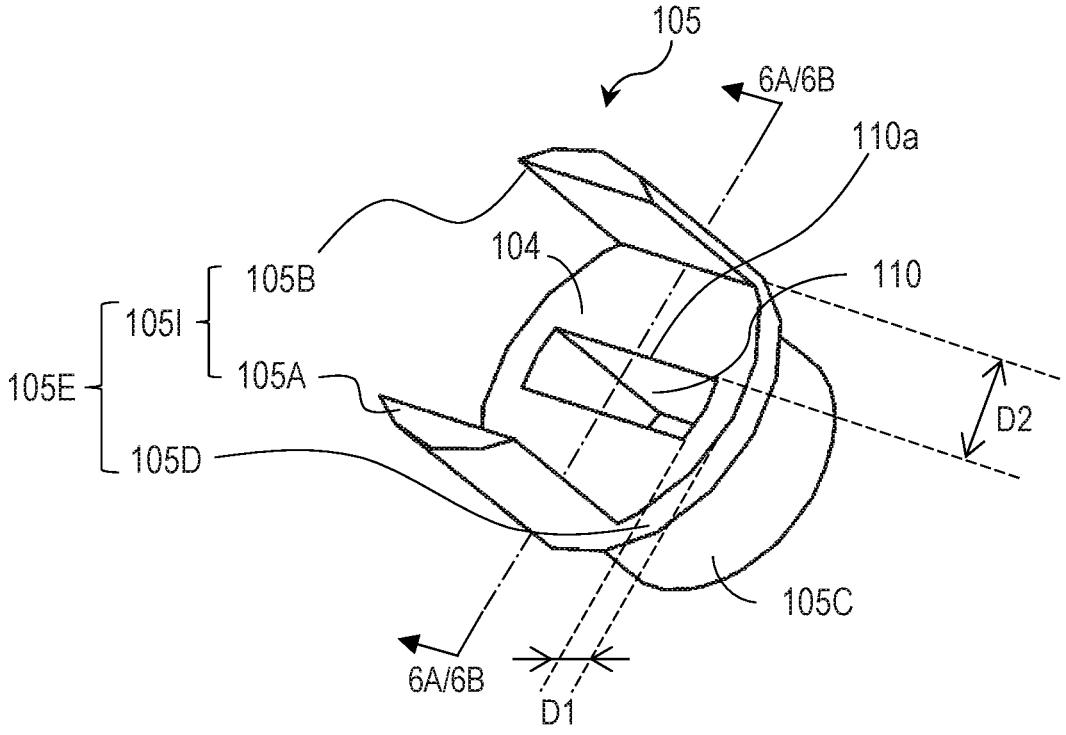
FIG. 5 is a schematic view illustrating a plug member of the liquid storage container of the first embodiment of the present invention.
Figure 6A:
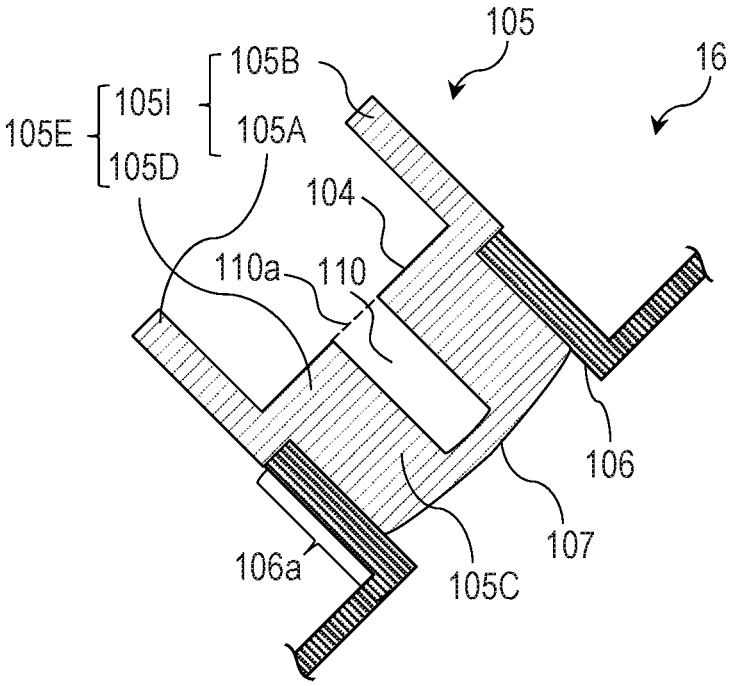
FIGS. 6A and 6B are schematic views illustrating cross-sectional structures of the plug member illustrated in FIG. 5.
Figure 6B:
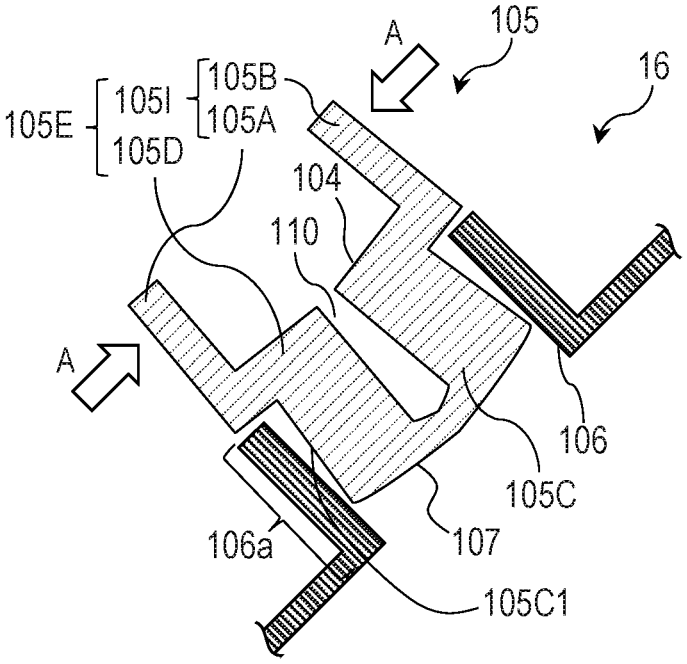

FIG. 5 is a view for explaining a configuration of the plug member 105 of the liquid storage container 16 of the present embodiment. FIGS. 6A and 6B are schematic views illustrating a cross-sectional structure of the plug member 105 illustrated in FIG. 5 taken along the line 6A/6B-6A/6B. FIG. 6A illustrates the state where the plug member 105 is attached to the supply port 106. FIG. 6B illustrates the state where the plug member 105 is to be removed from the supply port 106.

As illustrated in FIG. 5 as well as FIGS. 6A and 6B, the plug member 105 has a body portion 105E and a plug portion 105C. In order to obtain a sealing property capable of preventing the liquid from leaking from the supply port 106, the plug member 105 is made of a flexible member (elastically deformable member), for example, an elastic body such as rubber. The plug portion 105C is inserted into the supply port 106 to seal the supply port 106. Here, the plug portion 105C is attachably and detachably attached to the supply port 106. The supply port 106 has a hollow protruding portion 106*a* protruding from the storage chamber 100, and the entire plug portion 105C is inserted into the hollow tubular portion 106*a*. Here, the hollow protruding portion 106*a* is a hollow cylindrical portion having a circular cross-sectional shape. Nevertheless, the protruding portion 106*a* is not limited to a cylindrical one but may be one having another hollow shape.

The body portion 105E has a cover portion 105D and a pinch portion 105I. The cover portion 105D is formed integrally with the plug portion 105C, and covers the supply port 106 from outside the storage chamber 100 in the state where the entire plug portion 105C is inserted in the hollow protruding portion 106*a*. A hollow portion 110 extends from the cover portion 105D into the plug portion 105C. Here, the hollow portion 110 penetrates the cover portion 105D, but does not penetrate the plug portion 105C. The plug portion 105C and the cover portion 105D are made of an elastic body, and the hollow portion 110 has an opening on the cover portion 105D side. Specifically, an opening 110*a* of the hollow portion 110 is provided in an upper face 104 of the cover portion 105D, which is the face on the opposite side to the plug portion 105C. The upper face 104 of the cover portion 105D is parallel to the opening face of the supply port 106 in a state where the entire plug portion 105C is inserted in the hollow protruding portion 106*a*.

The pinch portion 105I is provided in the cover portion 105D. The pinch portion 105I includes a first portion and a second portion which are opposite to each other. The width of the opening 110*a* is narrowed and the side face of the plug portion 105C is deformed toward the hollow portion 110 by pinching the first and second portions. For example, when the first and second portions are pinched in the state where the plug portion 105C is inserted in the hollow protruding portion 106*a*, the side faces of the plug portion 105C are partially separated from the inner wall faces of the protruding portion 106*a*. Specifically, the plug portion 105C and the cover portion 105D are elastically deformed such that side faces 105C1 of the plug portion 105C which are opposite to each other with the hollow portion 110 in between are separated from the inner wall faces of the hollow protruding portion 106*a*.

As explained in more detail, the pinch portion 105I has a first protruding portion 105A and a second protruding portion 105B as the first portion and the second portion. The first protruding portion 105A and the second protruding portion 105B protrude from the upper face 104 of the cover portion 105D. Here, the first protruding portion 105A and the second protruding portion 105B protrude in a direction perpendicular to the upper face 104. The first protruding portion 105A and the second protruding portion 105B are opposite to each other with the opening 110*a* of the hollow portion 110 in between. The first protruding portion 105A and the second protruding portion 105B have such a size (width, height, and interval) that they can be pinched or applied with force by fingers, or the like.

The cross-sectional shape of the hollow portion 110 in a cross-section parallel to the upper face 104 of the cover portion 105D is a rectangular shape that is long in a first direction. The opening 110*a* of the hollow portion 110 also has a similar rectangular shape. The plug portion 105C and the cover portion 105D have four side walls which form the hollow portion 110. The first direction is parallel to the lengthwise direction of the opening 110*a* (the longer sides of the rectangular shape). A second direction orthogonal to the first direction is parallel to the widthwise direction of the opening 110*a* (the shorter sides of the rectangular shape). The thickness of the side walls facing the shorter sides is thinner than the thickness of the side walls facing the longer sides. For example, in FIG. 5, in the cover portion 105D, the thickness D1 of the side walls facing the shorter sides (the side walls parallel to the second direction) is thinner than the thickness D2 of the side walls facing the longer sides (the side walls parallel to the first direction). Although not illustrated in FIG. 5, the thicknesses of the side walls of the plug portion 105C also have a similar relation to the cover portion 105D. This allows the plug portion 105C and the cover portion 105D to have structures that are likely to deform in the second direction.

In the liquid storage container 16 of the present embodiment, there is a case where the liquid adheres to a front end face 107 of the plug portion 105C, which is exposed to the storage chamber 100, due to the rocking of the liquid in the storage chamber 100, for example.

Since the liquid storage container 16 of the present embodiment makes it possible to reduce the back action and impact at the time of removing the plug member 105 from the supply port 106, it is possible to suppress the scattering of the liquid at the time of opening.

Hereinafter, the operations and effects of the liquid storage container 16 of the present embodiment will be described with reference to Comparative Example.

Comparative Example

Figure 7:
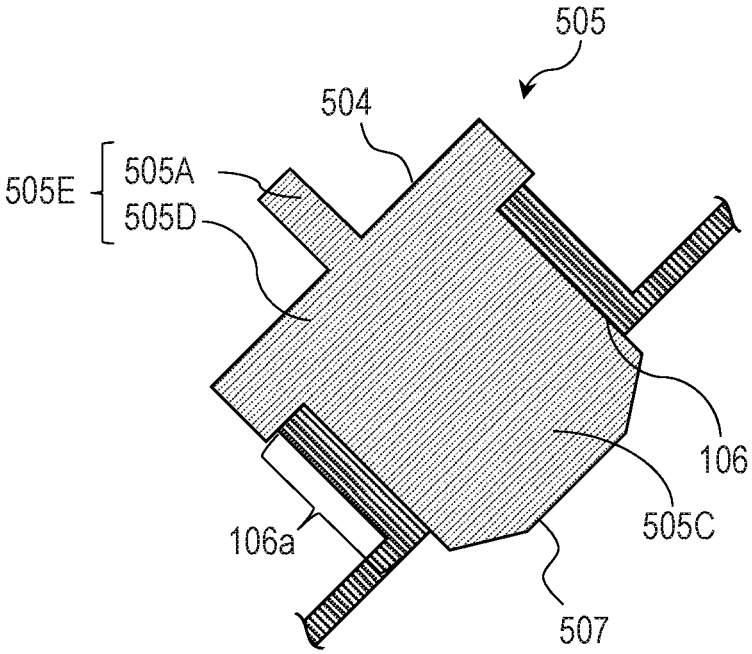
FIG. 7 is a schematic view illustrating a cross-sectional structure of a plug member of a liquid storage container which is Comparative Example.

FIG. 7 illustrates a configuration of a plug member 505 of a liquid storage container which is Comparative Example. The plug member 505 has a body portion 505E and a plug portion 505C. The plug portion 505C is inserted into a hollow protruding portion 106*a* to seal a supply port 106. The body portion 505E has a projecting portion 505A and a cover portion 505D. The cover portion 505D is formed integrally with the plug portion 505C, and covers the supply port 106 in the state where the plug portion 505C is inserted in the hollow protruding portion 106*a*. The projecting portion 505A protrudes from the upper face of the cover portion 505D. The front end of the plug portion 505C is exposed to the inside of the storage chamber 100 in a state where the entire plug portion 505C is inserted in the hollow protruding portion 106*a*. The liquid adheres to the exposed part of the plug portion 505C due to the rocking of the liquid in the storage chamber 100.

The plug member 505 can be removed from the supply port 106 by pinching and pulling the projecting portion 505A. In general, the larger the frictional force generated between the inner wall face of the hollow protruding portion 106*a* and the side face of the plug portion 505C, the larger the back action and impact at the time of opening. For example, if the frictional force is large, it is necessary to pull the projecting portion 505A with a larger force, which increases the back action and impact at the time of opening. The larger the back action and impact at the time of opening, the higher the possibility that the liquid having adhered to the plug portion 505C scatters at the time of opening. In the liquid storage container of Comparative Example, since the frictional force to be generated between the inner wall face of the hollow protruding portion 106*a* and the side face of the plug portion 505C is large, the back action and impact at the time of opening becomes large, resulting in the scattering of the liquid at the time of opening.

In contrast, in the liquid storage container 16 of the present embodiment, as illustrated in FIG. 6B, when the first protruding portion 105A and the second protruding portion 105B are pinched in the directions of the arrows A, the side face 105C1 of the plug portion 105C separates from the inner wall face of the hollow protruding portion 106*a*. This reduces the contact area and the contact pressure between the side face of the plug portion 105C and the inner wall face of the hollow protruding portion 106*a*, thus reducing the frictional force to be generated between the side face of the plug portion 105C and the inner wall face of the hollow protruding portion 106*a*. Hence, it is possible to reduce the back action and impact at the time of opening and suppress the scattering of the liquid at the time of opening.

Note that in the liquid storage container 16 of the present embodiment, if the hollow portion 110 provided in the plug portion 105C is too shallow, the thickness of the plug portion 105C on the front end side increases. In this case, when the first protruding portion 105A and the second protruding portion 105B are pinched, the plug portion 105C does not sufficiently elastically deform, so that the frictional force between the side face of the plug portion 105C and the inner wall face of the hollow protruding portion 106*a* increases. On the other hand, if the hollow portion 110 provided in the plug portion 105C is too deep, the thickness of the plug portion 105C on the front end side decreases. In this case, the plug portion 105C easily elastically deforms, and as a result, the contact pressure between the side face of the plug portion 105C and the inner wall face of the hollow protruding portion 106*a* unnecessarily decreases to impair the sealing property. It is favorable to appropriately set the depth of the hollow portion 110 in consideration of these points.

Specifically, the depth of the hollow portion 110 is set such that the sealing property is not impaired and the frictional force is reduced. More favorably, the depth of the hollow portion 110 is set such that when the first protruding portion 105A and the second protruding portion 105B are pinched, the front end face 107 of the plug portion 105C is curved along the bottom face portion of the hollow portion 110. This causes the side face of the plug portion 105C to separate from the inner wall face of the hollow protruding portion 106*a* also at a position close to the storage chamber 100, and thus is effective in reducing the frictional force between the side face of the plug portion 105C and the inner wall face of the hollow protruding portion 106*a*.

In addition, the arrangement of the first protruding portion 105A, the second protruding portion 105B, and the hollow portion 110 is not limited to the arrangement illustrated in FIG. 5 as well as FIGS. 6A and 6B. The first protruding portion 105A and the second protruding portion 105B may be arranged at any positions as long as they are opposite to each other with the opening 110*a* of the hollow portion 110 in between. For example, the first protruding portion 105A and the second protruding portion 105B may be arranged at asymmetrical positions as viewed from the upper face 104 of the cover portion 105D. In addition, the first protruding portion 105A and the second protruding portion 105B may be integrally formed.

Moreover, the shapes of the first protruding portion 105A and the second protruding portion 105B are not limited to the shapes illustrated in FIG. 5 as well as FIGS. 6A and 6B. For example, the front ends of the first protruding portion 105A and the second protruding portion 105B may have a bulging shape such as a cuboid, a non-flat shape, or a shape like a sphere.

This makes it easy for the fingers to get caught on the front ends and to apply a force when pinching the first protruding portion 105A and the second protruding portion 105B.

Moreover, the shape of the upper face 104 of the cover portion 105D is not limited to a circle. The upper face 104 of the cover portion 105D may be, for example, a symmetrical shape such as a rectangle or an asymmetrical shape.

Second Embodiment

Figure 8A:
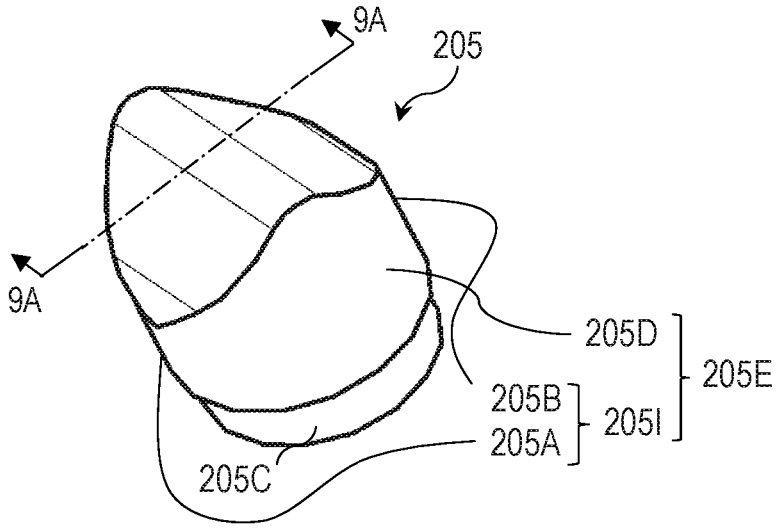
FIGS. 8A and 8B are perspective views illustrating a plug member of a liquid storage container of a second embodiment of the present invention.
Figure 8B:
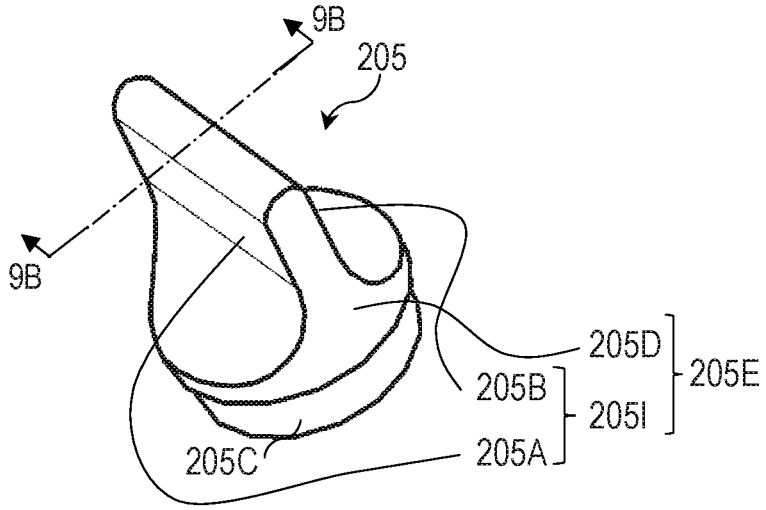
Figure 9A:
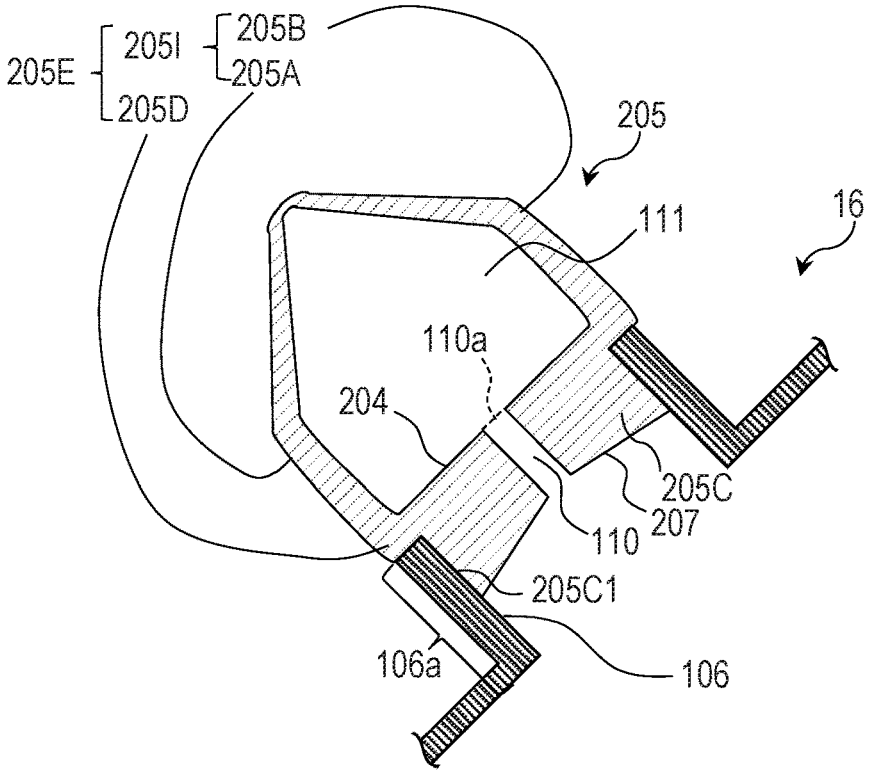
FIGS. 9A and 9B are schematic views illustrating cross-sectional structures of the plug member illustrated in FIGS. 8A and 8B.
Figure 9B:
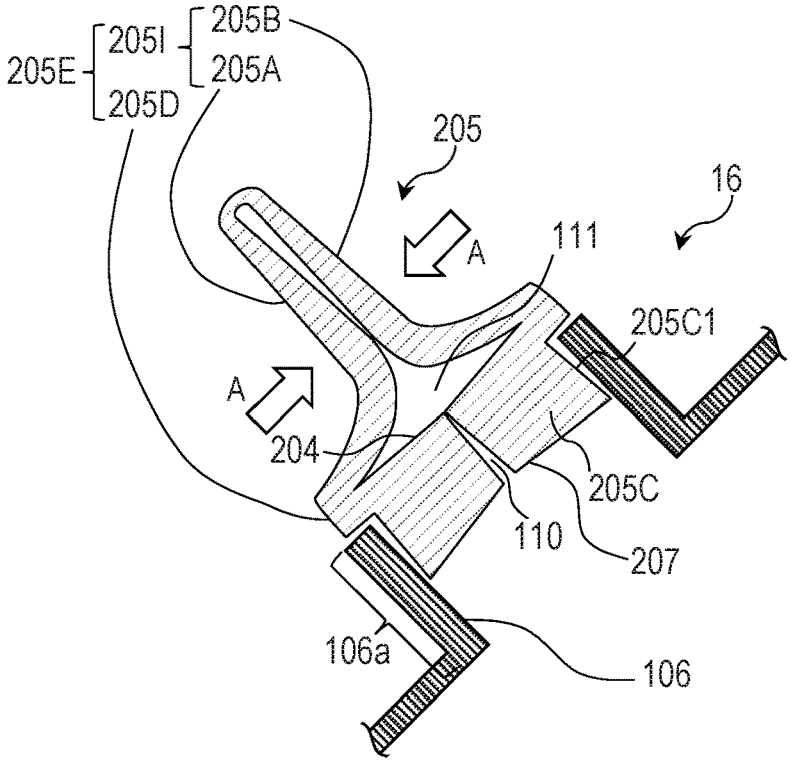

FIGS. 8A and 8B are perspective views illustrating an external appearance of a plug member used in a liquid storage container according to a second embodiment of the present invention. FIG. 8A illustrates the state of the plug member before being pinched, and FIG. 8B illustrates the state of the pinched plug member. FIGS. 9A and 9B are schematic views illustrating the state where the plug member illustrated in FIGS. 8A and 8B is attached to the supply port of the storage chamber. FIG. 9A illustrates a cross-sectional structure of the plug member taken along the line 9A-9A in FIG. 8A, and FIG. 9B illustrates a cross-sectional structure of the plug member taken along the line 9B-9B in FIG. 8B.

Hereinafter, a liquid storage container 16 of the present embodiment will be described in detail with reference to FIGS. 8A and 8B as well as FIGS. 9A and 9B.

Note that since the basic configuration of the liquid storage container 16 of the present embodiment is the same as that of the liquid storage container 16 of the first embodiment, only the characteristic configuration will be described below.

A plug member 205 has a body portion 205E and a plug portion 205C. The plug portion 205C is inserted into a hollow protruding portion 106*a* to seal a supply port 106. The body portion 205E has a cover portion 205D and a pinch portion 2051. The cover portion 205D is formed integrally with the plug portion 205C, and covers the supply port 106 from outside the storage chamber 100 in the state where the entire plug portion 205C is inserted in the hollow protruding portion 106*a*. In the present embodiment, a hollow portion 110 penetrates both of the plug portion 205C and the cover portion 205D. Inside the pinch portion 2051, a space 111 which communicates with the hollow portion 110 is formed.

An upper face 204 of the cover portion 205D has an opening 110*a* of the hollow portion 110. The pinch portion 2051 is formed integrally with the cover portion 205D. The pinch portion 2051 is made of a projecting elastic member provided on the upper face 204 of the cover portion 205D in such a manner as to cover the space 111 communicating with the opening 110*a*. The pinch portion 2051 has a first pinch portion 205A and a second pinch portion 205B which are opposite to each other. The first pinch portion 205A and the second pinch portion 205B can be pinched with fingers or the like. The hollow portion 110 is located between the first pinch portion 205A and the second pinch portion 205B.

In the present embodiment, as illustrated in FIG. 8B, when the first pinch portion 205A and the second pinch portion 205B are pinched, the first pinch portion 205A and the second pinch portion 205B elastically deform toward the center portion of the pinch portion 2051.

To remove the plug member 205 from the supply port 106, as illustrated in FIG. 9B, the first pinch portion 205A and the second pinch portion 205B are pinched in the directions of the arrows A. When the first pinch portion 205A and the second pinch portion 205B are pinched, side faces 205C1 of the plug portion 205C which are opposite to each other with the hollow portion 110 in between separate from the inner wall faces of the hollow protruding portion 106*a*. This reduces the contact area and the contact pressure between the side face of the plug portion 205C and the inner wall face of the hollow protruding portion 106*a*, thus reducing the frictional force to be generated between the side face of the plug portion 205C and the inner wall face of the hollow protruding portion 106*a*. Hence, it is possible to reduce the back action and impact at the time of opening and suppress the scattering of the liquid at the time of opening.

In addition, pinching the first pinch portion 205A and the second pinch portion 205B reduces the volume of the space 111. As a result, air flows from the space 111 into the storage chamber 100 through the hollow portion 110. This air flow allows the liquid having adhered to the front end face 207 of the plug portion 205C, particularly part of the front end face 207 near the hollow portion 110 to be blown off into the storage chamber 100. In this way, since the liquid having adhered to the front end face 207 of the plug portion 205C can be blown off, it is possible to more securely suppress the scattering of the liquid at the time of opening.

In the liquid storage container 16 of the present embodiment, the arrangement of the first pinch portion 205A, the second pinch portion 205B, and the hollow portion 110 is not limited to the arrangement illustrated in FIGS. 8A and 8B as well as FIGS. 9A and 9B. The first pinch portion 205A and the second pinch portion 205B may be arranged at any positions as long as they are opposite to each other with the hollow portion 110 in between. For example, the first pinch portion 205A and the second pinch portion 205B may be arranged at asymmetrical positions as viewed from the upper face 204 of the cover portion 205D.

In addition, the shape of the pinch portion 2051 is not limited to the shape illustrated in FIGS. 8A and 8B as well as FIGS. 9A and 9B. For example, the pinch portion 2051 may have any shape as long as the frictional force can be reduced by pinching the pinch portion 2051.

Third Embodiment

Figure 10A:
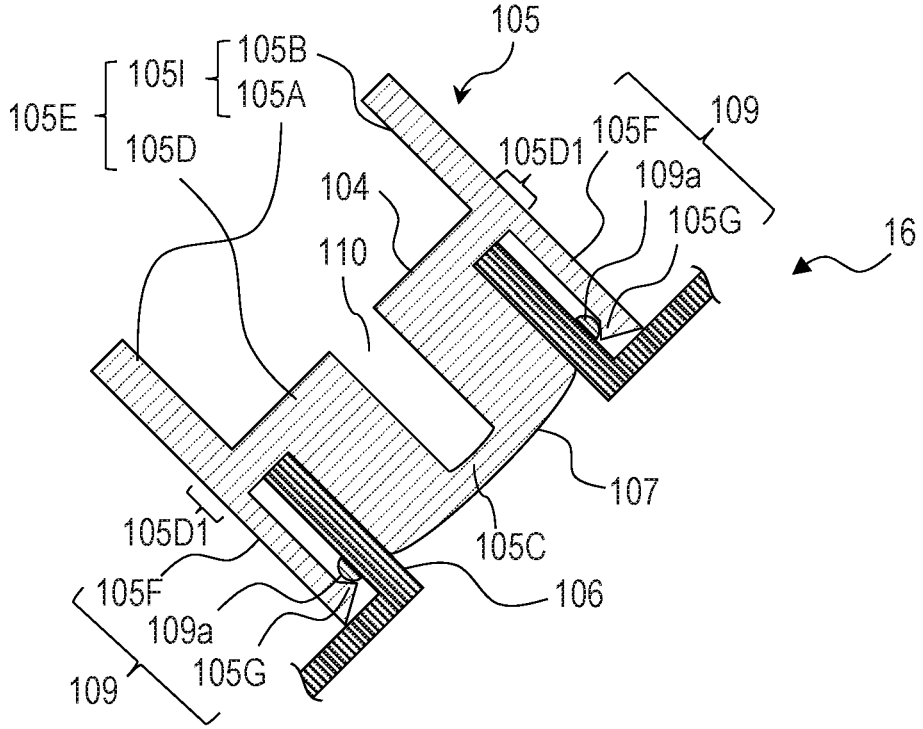
FIGS. 10A and 10B are schematic views illustrating cross-sectional structures of a plug member of a liquid storage container of a third embodiment of the present invention.
Figure 10B:
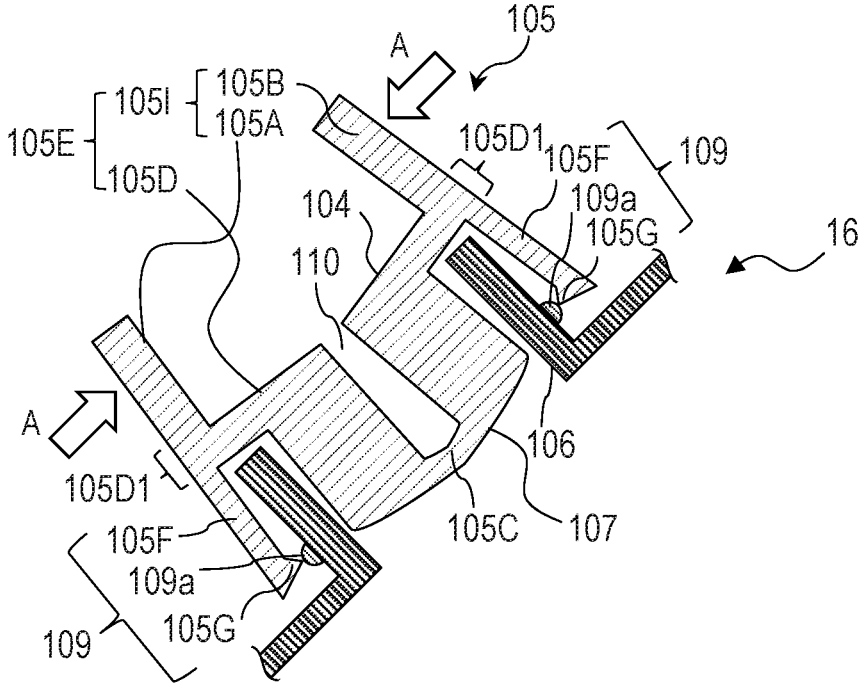

FIGS. 10A and 10B are schematic views for explaining a configuration of a plug member of a liquid storage container according to a third embodiment of the present invention. FIG. 10A illustrates the state where the plug member is attached to a supply port. FIG. 10B illustrates the state where the plug member attached to the supply port is pinched. FIGS. 10A and 10B correspond to cross-sections taken along the line 10A/10B-10A/10B in FIG. 4.

Hereinafter, a liquid storage container 16 of the present embodiment will be described in detail with reference to FIGS. 10A and 10B. Note that since the basic configuration of the liquid storage container 16 of the present embodiment is the same as that of the liquid storage container 16 of the first embodiment, only the characteristic configuration will be described below.

The liquid storage container 16 of the present embodiment includes fixation members 109 which fix the plug member 105 to the supply port 106 in the state where the entire plug portion 105C is inserted in the hollow protruding portion 106*a*. Pinching the pinch portion 105I releases the fixation by the fixation members 109. The fixation members 109 may include first engagement portions provided on the cover portion 105D and second engagement portions provided on the outer wall face of the protruding portion 106*a*, for example. In this case, the cover portion 105D is engaged with the outer wall face of the protruding portion 106*a* by means of the first engagement portions and the second engagement portions. The fixation members including the first and second engagement portions may be provided at positions opposite to each other with the center of the protruding portion 106*a* in between. Preferably, the fixation members including the first and second engagement portions may be provided corresponding to the first protruding portion 105A and the second protruding portion 105B.

Specifically, the second engagement portions include protrusions 109*a* provided on the outer wall face of the hollow protruding portion 106*a*, and the first engagement portions include arm members 105F extending from the cover portion 105D to the protrusions 109*a* along the outer wall face of the hollow protruding portion 106*a*. Claw portions 105G are provided on the front ends of the arm members 105F. The claw portions 105G are provided to protrude from the front ends of the arm members 105F toward the protrusions 109*a*. The claw portions 105G on the front ends of the arm members 105F engage with the protrusions 109*a* in the state where the entire plug portion 105C is inserted in the hollow protruding portion 106*a*. Here, the engagement means that the claw portion 105G is get caught on the protrusion 109*a*. The claw portions 105G are released from the protrusions 109*a* by pinching the pinch portion 105I.

In the present embodiment, two arm members 105F and two protrusions 109*a* are provided corresponding to the first protruding portion 105A and the second protruding portion 105B. The first protrusion 109*a* and the second protrusion 109*a* are provided at positions opposite to each other. Here, the first arm member 105F and the first protruding portion 105A are linearly arranged, and the second arm member 105F and the second protruding portion 105B are linearly arranged. The cover portion 105D includes a first connecting portion 105D1, which connects the first arm member 105F and the first protruding portion 105A, and a second connecting portion 105D1, which connects the second arm member 105F and the second protruding portion 105B.

As illustrated in FIG. 10B, the first protruding portion 105A and the second protruding portion 105B are pinched in the directions of the arrows A. The first arm member 105F turns at the first connecting portion 105D1 in the direction away from the outer wall face of the hollow protruding portion 106*a*, so that the claw portion 105G is released from the first protrusion 109*a*. In the same manner, the second arm member 105F turns at the second connecting portion 105D1 in the direction away from the outer wall face of the hollow protruding portion 106*a*, so that the claw portion 105G is released from the second protrusion 109*a*.

In the liquid storage container 16 of the present embodiment, when the plug member 105 is attached to the supply port 106, the entire plug portion 105C is inserted into the hollow protruding portion 106*a* to engage the claw portions 105G of the respective arm members 105F with the respective protrusions 109*a*, as illustrated in FIG. 10A. Since this makes it possible to fix the plug member 105 to the supply port 106, it is possible to securely suppress leakage of the liquid due to the rocking of the liquid when the liquid ejection apparatus 200 is moved, for example. In addition, it is also possible to prevent the plug member 105 from being unintentionally removed from the supply port 106.

To remove the plug member 105 from the supply port 106, as illustrated in FIG. 10B, the first protruding portion 105A and the second protruding portion 105B are pinched. When the first protruding portion 105A and the second protruding portion 105B are pinched, the side faces 105C1 of the plug portion 105C separate away from the inner wall faces of the hollow protruding portion 106*a*, and the claw portions 105G of the arm members 105F are released from the protrusions 109*a*. Releasing the claw portions 105G of the arm members 105F from the protrusions 109*a* allows the plug member 105 to be removed from the supply port 106. In addition, since the side faces of the plug portion 105C are partially separated from the inner wall faces of the hollow protruding portion 106*a*, it is possible to reduce the frictional force and to suppress the scattering of the liquid at the time of opening like the first embodiment.

Note that although in the liquid storage container 16 of the present embodiment, the fixation member 109 includes two arm members 105F and two protrusions 109*a*, the configuration is not limited to this. The numbers of the arm members 105F and the protrusions 109*a* included in the fixation member 109 may be one or more each.

In addition, although the claw portion 105G is configured to be engaged with the protrusion 109*a*, the configuration is not limited to this. The structure for fixing the claw portion 105G and the protrusion 109*a* may be replaced with the structure for fixing a projecting portion and a recess portion. In this case, the configuration may be such that one of the projecting portion and the recess portion is provided on the arm member 105F and the other is provided on the outer wall face of the hollow protruding portion 106*a*.

Fourth Embodiment

Figure 11A:
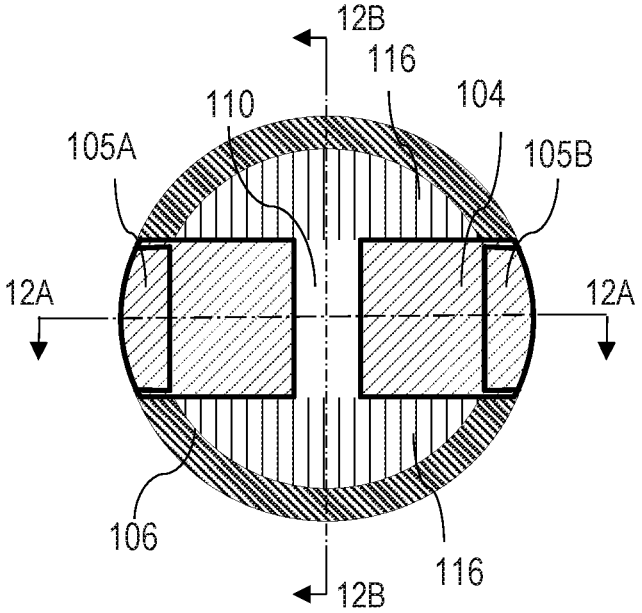
FIGS. 11A and 11B are schematic views illustrating a plug member of a liquid storage container of a fourth embodiment of the present invention.
Figure 11B:
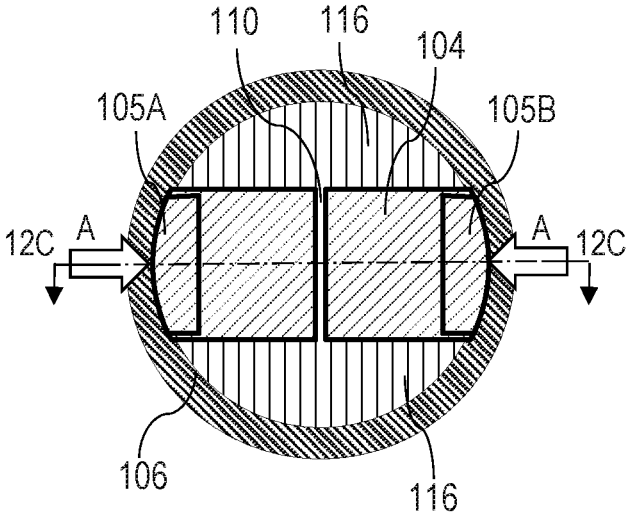
Figure 12A:
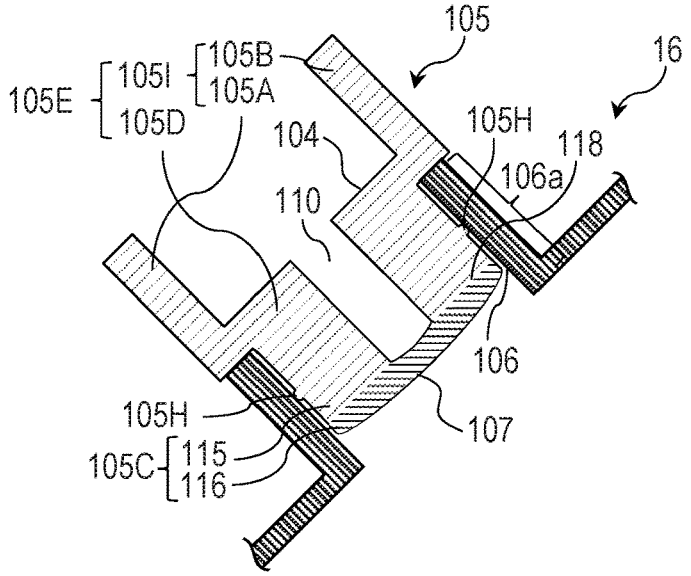
FIGS. 12A, 12B, and 12C are schematic views illustrating cross-sectional structures of the plug member illustrated in FIGS. 11A and 11B.
Figure 12B:
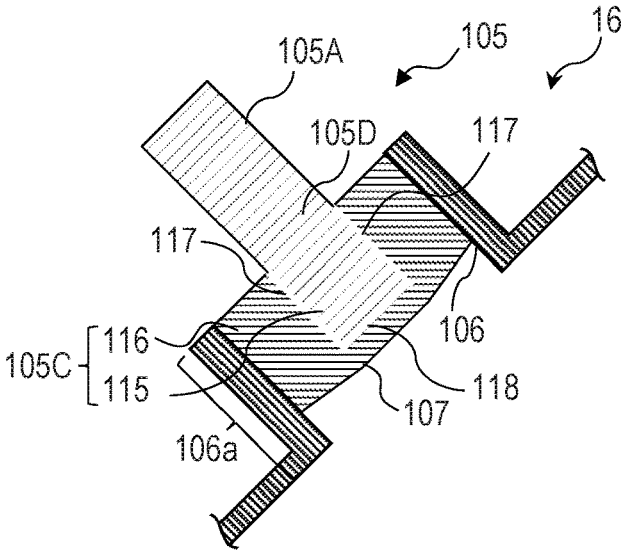
Figure 12C:
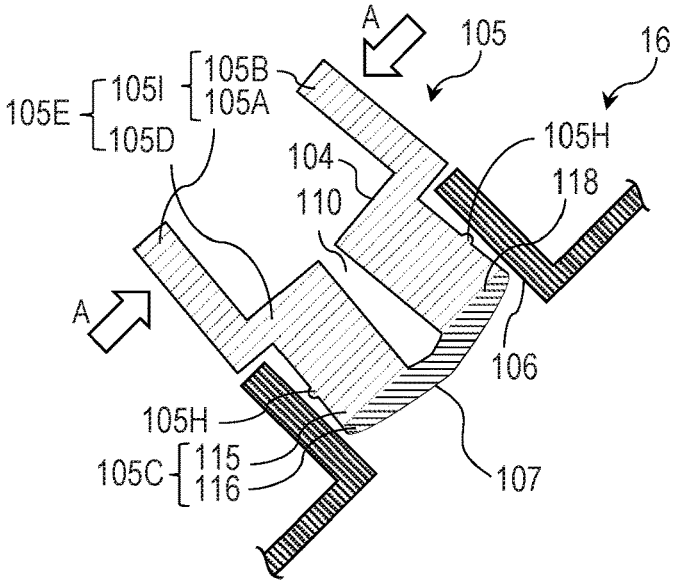

FIGS. 11A and 11B as well as FIGS. 12A to 12C are schematic views for explaining a configuration of a plug member of a liquid storage container according to a fourth embodiment of the present invention. FIG. 11A illustrates the state where the plug member is attached to a supply port. FIG. 11B illustrates the state where the plug member attached to the supply port is pinched. FIG. 12A illustrates a cross-sectional structure of the plug member taken along the line 12A-12A in FIG. 11A. FIG. 12B illustrates a cross-sectional structure of the plug member taken along the line 12B-12B in FIG. 11A. FIG. 12C illustrates a cross-sectional structure of the plug member taken along the line 12C-12C in FIG. 11B.

Hereinafter, a liquid storage container 16 of the present embodiment will be described in detail with reference to FIGS. 11A and 11B as well as FIGS. 12A to 12C. Note that since the basic configuration of the liquid storage container 16 of the present embodiment is the same as that of the liquid storage container 16 of the first embodiment, only the characteristic configuration will be described below.

In the liquid storage container 16 of the present embodiment, the plug portion 105C has a deforming portion 115 and a non-deforming portion 116. The deforming portion 115 elastically deforms when the first protruding portion 105A and the second protruding portion 105B are pinched. The non-deforming portion 116 has a structure which is unlikely to elastically deform even when the first protruding portion 105A and the second protruding portion 105B are pinched.

The deforming portion 115 includes a third side wall portion and a fourth side wall portion which are located directly below the first protruding portion 105A and the second protruding portion 105B, respectively, and are opposite to each other with the hollow portion 110 in between. On the outer periphery of the third and fourth side wall portions of the plug portion 105C, at least one ridge portion 105H which extends in a circumferential direction is provided. The non-deforming portion 116 includes a first side wall portion and a second side wall portion, which are opposite to each other with the hollow portion 110 in between, as well as a front end portion of the plug portion 105C. The first side wall portion and the second side wall portion are adjacent to the third side wall portion and the fourth side wall portion. In other words, the first to fourth side wall portions are side walls which form the hollow portion 110.

As illustrated in FIG. 11A as well as FIGS. 12A and 12B, the ridge portion 105H is in contact with the inner wall faces of the hollow protruding portion 106*a* in the state where the plug portion 105C is inserted in the hollow protruding portion 106*a*. At the third and fourth side wall portions among the side faces of the plug portion 105C, the ridge portions 105H come into contact with the inner wall faces of the hollow protruding portion 106*a* to secure the sealing property. At the first and second side wall portions, the side faces of the plug portion 105C come into contact with the inner wall faces of the hollow protruding portion 106*a* to secure the sealing property.

Among interfaces at which the deforming portion 115 and the non-deforming portion 116 are in contact, at an interface 117 between the first and second side wall portions and the third and fourth side wall portions, the deforming portion 115 and the non-deforming portion 116 are separate. At an interface 118 between the first and second side wall portions and the front end portion, the deforming portion 115 and the non-deforming portion 116 are integrally joined.

As illustrated in FIG. 11B and FIG. 12C, pinching the first protruding portion 105A and the second protruding portion 105B in the directions of the arrows A separates the ridge portion 105H from the inner wall face of the hollow protruding portion 106*a*. This make it possible to reduce the frictional force to be generated between the side faces of the plug portion 105C and the inner wall faces of the hollow protruding portion 106*a* at the third and fourth side wall portions among the side faces of the plug portion 105C. Hence, like the first embodiment, it is possible to reduce the back action and impact at the time of opening and suppress the scattering of the liquid at the time of opening.

Note that in the present embodiment, since the deforming portion 115 and the non-deforming portion 116 are separate at the interface 117, the first and second side wall portions of the non-deforming portion 116 are difficult to elastically deform even when the first protruding portion 105A and the second protruding portion 105B are pinched. The amount of deformation by which the third and fourth side wall portions deform toward the hollow portion 110 is larger than the amount of deformation by which the first and second side wall portions deform toward the hollow portion 110. In other words, the amount of deformation by which the first and second side wall portions deform toward the hollow portion 110 is sufficiently smaller than the amount of deformation by which the third and fourth side wall portions deform toward the hollow portion 110. Hence, it is possible to suppress an increase in frictional force to be generated between the first and second side wall portions of the plug portion 105C and the inner wall faces of the hollow protruding portion 106*a* when the first protruding portion 105A and the second protruding portion 105B are pinched.

Note that the ridge portion 105H may be provided not on the outer periphery of the third and fourth side walls of the plug portion 105C but on the inner wall face of the protruding portion 106*a* which is opposite to the outer periphery.

Fifth Embodiment

Figure 13A:
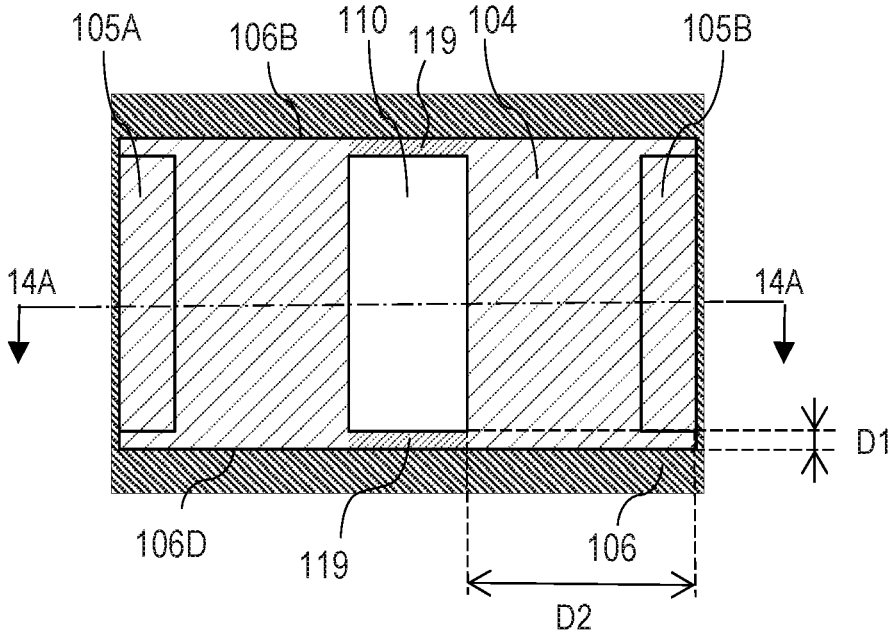
FIGS. 13A and 13B are schematic views illustrating a plug member of a liquid storage container of a fifth embodiment of the present invention.
Figure 13B:
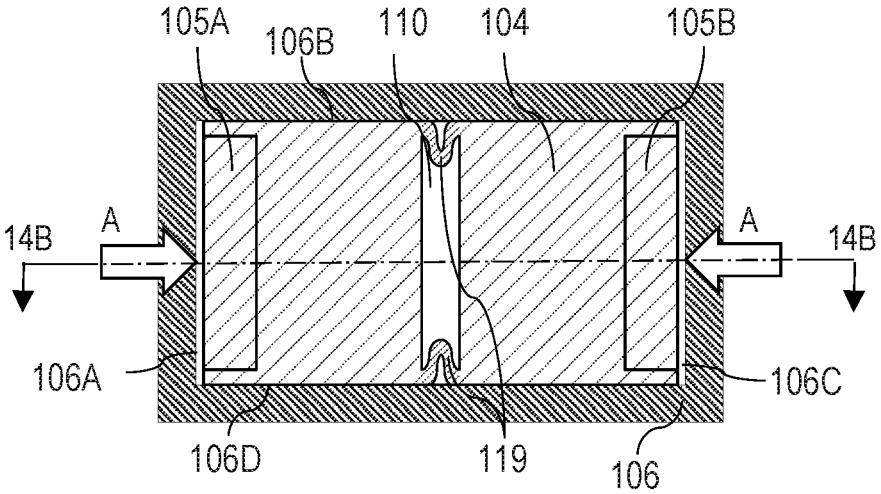
Figure 14A:
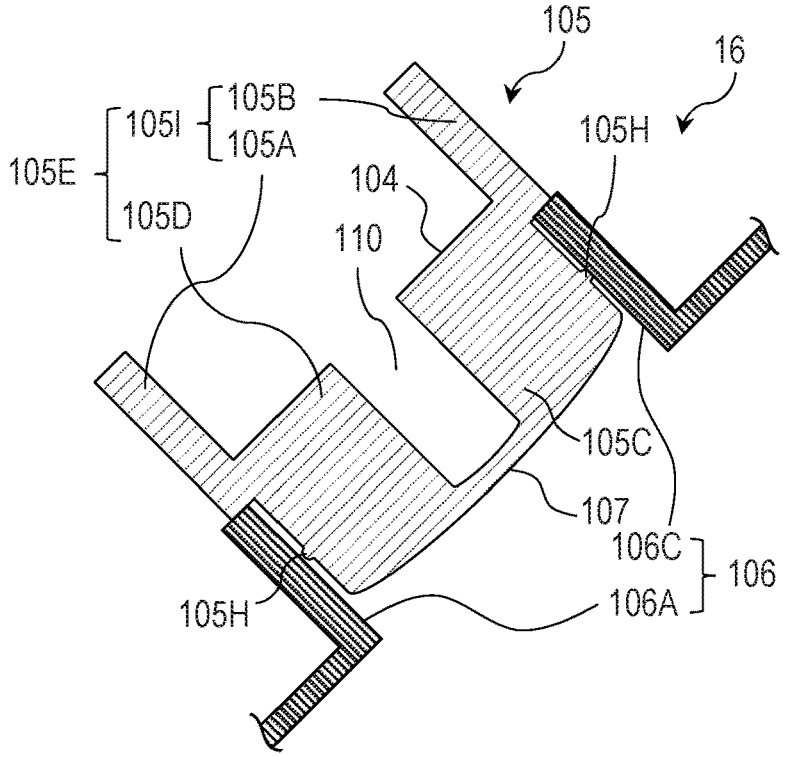
FIGS. 14A and 14B are schematic views illustrating cross-sectional structures of the plug member illustrated in FIGS. 13A and 13B.
Figure 14B:
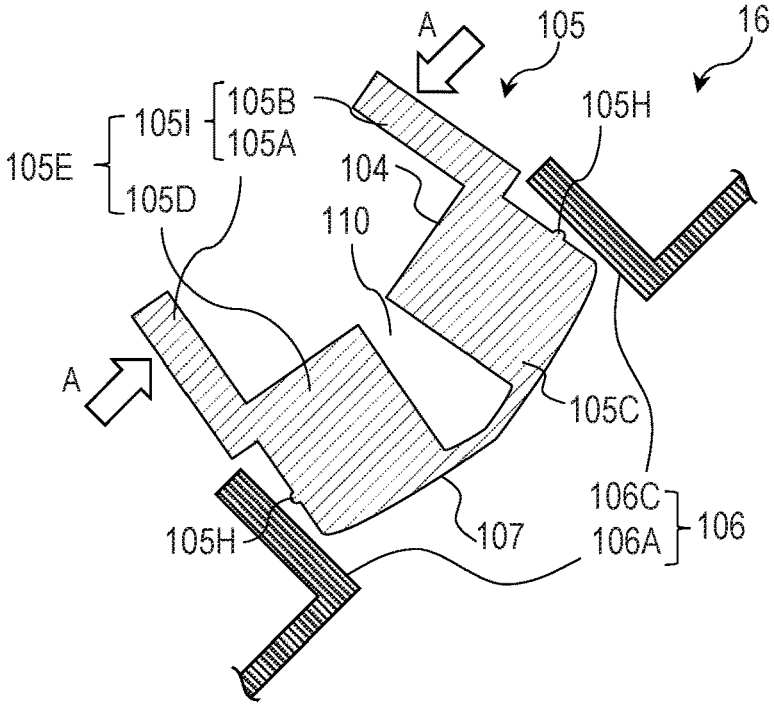

FIGS. 13A and 13B as well as FIGS. 14A and 14B are schematic views for explaining a configuration of a plug member of a liquid storage container according to a fifth embodiment of the present invention. FIG. 13A illustrates the state where the plug member is attached to a supply port. FIG. 13B illustrates the state where the plug member attached to the supply port is pinched. FIG. 14A illustrates a cross-sectional structure taken along the line 14A-14A in FIG. 13A. FIG. 14B illustrates a cross-sectional structure taken along the line 14B-14B in FIG. 13A.

Hereinafter, a liquid storage container 16 of the present embodiment will be described in detail with reference to FIGS. 13A and 13B as well as FIGS. 14A and 14B. Note that since the basic configuration of the liquid storage container 16 of the present embodiment is the same as that of the liquid storage container 16 of the first embodiment, only the characteristic configuration will be described below.

A supply port 106 includes a hollow protruding portion 106*a* which has a rectangular cross-sectional shape surrounded by four inner wall faces 106A, 106B, 106C, and 106D. The inner wall faces 106A and 106C are opposite to each other and the inner wall faces 106B and 106D are opposite to each other. The cross-sectional shape of a plug portion 105C is a rectangle, and the supply port 106 can be sealed by inserting the plug portion 105C into the hollow protruding portion 106*a*. The cross-sectional shape of an upper face 104 of a cover portion 105D is also a rectangle. The cover portion 105D covers the supply port 106 in the state where the entire plug portion 105C is inserted in the hollow protruding portion 106*a*.

The cross-sectional shape of a hollow portion 110, which is parallel to the upper face 104 of the cover portion 105D, is a rectangular shape that is long in the first direction (the direction orthogonal to the line 14A-14A). The plug portion 105C and the cover portion 105D have four side walls which form the hollow portion 110. The thickness D1 of the side walls facing the shorter sides is thinner than the thickness D2 of the side walls facing the longer sides. Here, the longer sides are parallel to the first direction, and the shorter sides are parallel to the second direction orthogonal to the first direction. The side walls facing the shorter sides form a folding portion 119, which is capable of being folded toward the inner side of the hollow portion 110.

In the state where the entire plug portion 105C is inserted in the hollow protruding portion 106*a*, the inner wall face 106A is located directly below a first protruding portion 105A and the inner wall face 106C is located directly below a second protruding portion 105B. Among the side faces of the plug portion 105C, side faces opposite to the inner wall faces 106A and 106C, respectively, are provided with at least one ridge portion 105H which extends in an outer circumferential direction. Note that the ridge portion 105H may be provided not on the side faces of the plug portion 105C but on the inner wall faces 106A and 106C.

As illustrated in FIG. 13A and FIG. 14A, the ridge portions 105H are in contact with the inner wall faces 106A and 106C of the hollow protruding portion 106*a* in the state where the plug portion 105C is inserted in the hollow protruding portion 106*a*. At the side faces opposite to the inner wall faces 106A and 106C among the side faces of the plug portion 105C, the ridge portions 105H come into contact with the inner wall faces of the hollow protruding portion 106*a* to secure the sealing property. At the side faces opposite to the inner wall faces 106B and 106D among the side faces of the plug portion 105C, the side faces of the plug portion 105C come into contact with the inner wall faces of the hollow protruding portion 106*a* to secure the sealing property.

As illustrated in FIG. 13B and FIG. 14B, pinching the first protruding portion 105A and the second protruding portion 105B in the directions of the arrows A folds the folding portion 119 toward the inner sides of the hollow portion 110. At the same time, the ridge portions 105H are separated from the inner wall faces 106A and 106C of the hollow protruding portion 106*a*. This makes it possible to reduce the frictional force to be generated between the side faces of the plug portion 105C and the inner wall faces 106A and 106C of the hollow protruding portion 106*a*. Hence, like the first embodiment, it is possible to reduce the back action and impact at the time of opening and suppress the scattering of the liquid at the time of opening.

In addition, since the folding portions 119 are folded toward the inner sides of the hollow portion 110, this makes it possible to suppress an increase in frictional force to be generated between the side faces of the plug portion 105C and the inner wall faces 106B and 106D of the hollow protruding portion 106*a*.

Another Embodiment

A liquid storage container of the present embodiment includes: a storage chamber which stores a liquid; a supply port which includes a hollow protruding portion protruding from the storage chamber and which is capable of supplying the liquid into the storage chamber; and a plug member which is made of an elastic body and which is configured such that a front end portion of the elastic body is inserted into the protruding portion. The plug member includes: a hollow portion which extends from the elastic body toward the front end portion; and a pinch portion which is provided on a rear end of the elastic body and which causes a side face of the front end portion to deform toward the hollow portion. The pinch portion includes a first portion and a second portion which are opposite to each other with the hollow portion in between in a first direction intersecting the hollow portion. The front end portion of the elastic body is more likely to deform in the first direction than in a second direction which is orthogonal to the first direction.

According to the liquid storage container of the present embodiment, the outer diameter of the front end portion of the elastic body in the first direction is reduced by pinching the first and second portions. Reduction in the outer diameter of the front end portion makes it possible to reduce the back action and impact at the time of removing the front end portion inserted in the hollow tubular portion. Hence, like the above-described first to fifth embodiments, it is possible to suppress the scattering of the liquid at the time of opening.

Note that in the liquid storage container of the present embodiment, the storage chamber 100, the supply port 106, and the plug member 105, 205, which are described in the first to fifth embodiments, may be applied to the storage chamber, the supply port, and the plug member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-037186, filed Mar. 9, 2021, which is hereby incorporated by reference herein in its entirety.

What is claimed is:

1. A liquid storage container comprising:

a storage chamber which stores a liquid;

a supply port which is capable of supplying the liquid into the storage chamber;

a hollow protruding portion which protrudes from the supply port; and a plug member which is attachably and detachably attached to the supply port, wherein the plug member includes:

a plug portion which is inserted into the protruding portion to seal the supply port;

a cover portion which is formed integrally with the plug portion and which covers the supply port from outside the storage chamber in a state where the plug portion is inserted in the protruding portion;

a pinch portion which is provided on the cover portion and which includes a first portion and a second portion which are opposite to each other; and a hollow portion which is located between the first portion and the second portion and which extends from the cover portion into the plug portion, the plug portion and the cover portion are made of an elastic body, the hollow portion has an opening on the cover portion side, and a width of the opening is narrowed and a side face of the plug portion is deformed toward the hollow portion by pinching the first and second portions.

2. The liquid storage container according to claim 1, wherein the side face of the plug portion is partially separated from an inner wall face of the protruding portion by pinching the first and second portions in the state where the plug portion is inserted in the protruding portion.

3. The liquid storage container according to claim 1, wherein the opening of the hollow portion is provided in an upper face of the cover portion which is a face opposite to the plug portion, the first portion and the second portion are a first protruding portion and a second protruding portion which protrude from the upper face of the cover portion, and the first and second protruding portions are opposite to each other with the opening in between.

4. The liquid storage container according to claim 1, wherein the hollow portion penetrates both of the plug portion and the cover portion, the opening of the hollow portion is provided in an upper face of the cover portion which is a face opposite to the plug portion, the pinch portion is provided on the upper face of the cover portion in such a manner as to cover a space which communicates with the opening, and is made of a protruding elastic member including the first portion and the second portion.

5. The liquid storage container according to claim 3, wherein a cross-sectional shape of the hollow portion in a cross-section parallel to the upper face of the cover portion is a rectangular shape which is long in a first direction, the plug portion includes first to fourth side walls which form the hollow portion, the third side wall and the fourth side wall are parallel to the first direction, the first side wall and the second side wall are parallel to a second direction which is orthogonal to the first direction, the third side wall is located directly below the first portion, and the fourth side wall is located directly below the second portion.

6. The liquid storage container according to claim 5, wherein an amount of deformation by which the third and fourth side walls deform toward the hollow portion is larger than an amount of deformation by which the first and second side walls deform toward the hollow portion.

7. The liquid storage container according to claim 5, wherein a thickness of each of the first and second side walls is thinner than a thickness of each of the third and fourth side walls.

8. The liquid storage container according to claim 7, wherein the first and second side walls are capable of being folded toward an inner side of the hollow portion.

9. The liquid storage container according to claim 5, further comprising:

a ridge portion which extends in a circumferential direction, on an outer periphery of the third and fourth side walls of the plug portion, or on an inner wall face of the protruding portion which is opposite to the outer periphery.

10. The liquid storage container according to claim 1, further comprising:

a fixation member which fixes the plug member to the supply port in the state where the entire plug portion is inserted in the protruding portion, wherein the fixation by the fixation member is released by pinching the pinch portion.

11. The liquid storage container according to claim 10, wherein the fixation member includes a first engagement portion provided on the cover portion and a second engagement portion provided on an outer wall face of the protruding portion, and the cover portion is engaged with the outer wall face of the protruding portion by the first engagement portion and the second engagement portion.

12. The liquid storage container according to claim 11, wherein the second engagement portion includes a protrusion provided on the outer wall face of the protruding portion, the first engagement portion includes an arm member which extends from the cover portion to the protrusion along the outer wall face of the protruding portion, a front end of the arm member engages with the protrusion in the state where the entire plug portion is inserted in the protruding portion, and the front end of the arm member is released from the protrusion by pinching the first and second portions.

13. A liquid storage container comprising:

a storage chamber which stores a liquid;

a supply port which is capable of supplying the liquid into the storage chamber;

a hollow protruding portion which protrudes from the supply port; and a plug member which is made of an elastic body and which is configured such that a front end portion of the elastic body is inserted into the protruding portion, wherein the plug member includes:

a hollow portion which is provided on the front end portion of the elastic body and which extends in a direction of insertion of the front end portion, and a pinch portion which is provided on a rear end of the elastic body and which causes a side face of the front end portion to deform toward the hollow portion, the pinch portion includes a first portion and a second portion which are opposite to each other with the hollow portion in between in a first direction which intersects the hollow portion, and the front end portion is more likely to deform in the first direction than in a second direction which is orthogonal to the first direction.

14. A liquid ejection apparatus comprising:

a liquid storage container including:

a storage chamber which stores a liquid;

a supply port which is capable of supplying the liquid into the storage chamber;

a hollow protruding portion which protrudes from the supply port; and a plug member which is attachably and detachably attached to the supply port, in which the plug member includes:

a plug portion which is inserted into the protruding portion to seal the supply port;

a cover portion which is formed integrally with the plug portion and which covers the supply port from outside the storage chamber in a state where the plug portion is inserted in the protruding portion;

a pinch portion which is provided on the cover portion and which includes a first portion and a second portion which are opposite to each other; and a hollow portion which is located between the first portion and the second portion and which extends from the cover portion into the plug portion, the plug portion and the cover portion are made of an elastic body, the hollow portion has an opening on the cover portion side, and a width of the opening is narrowed and a side face of the plug portion is deformed toward the hollow portion by pinching the first and second portions; and a liquid ejection head which ejects the liquid, wherein the liquid is supplied from the liquid storage container into the liquid ejection head.

15. The liquid ejection apparatus according to claim 14, further comprising:

a housing portion which includes an openable and closable cover and which houses the liquid storage container, wherein the liquid storage container housed in the housing portion is such that the storage chamber is capable of being supplied with the liquid from the supply port in a state where the cover is opened.

* * * * *